US007117925B2

(12) United States Patent
Strezov et al.

(10) Patent No.: US 7,117,925 B2
(45) **Date of Patent: *Oct. 10, 2006**

(54) PRODUCTION OF THIN STEEL STRIP

(75) Inventors: Lazar Strezov, Adamstown Heights (AU); Kannappar Mukunthan, Rankin Park (AU); Walter Blejde, Brownsburg, IN (US); Rama Mahaptra, Brighton-Le-Sands (AU)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/197,204

(22) Filed: Aug. 4, 2005

(65) Prior Publication Data

US 2006/0144552 A1 Jul. 6, 2006

Related U.S. Application Data

(60) Continuation-in-part of application No. 10/689,284, filed on Oct. 20, 2003, now abandoned, which is a division of application No. 09/967,166, filed on Sep. 28, 2001, now Pat. No. 6,675,869.

(60) Provisional application No. 60/270,861, filed on Feb. 26, 2001, provisional application No. 60/236,389, filed on Sep. 29, 2000.

(51) Int. Cl.

| | |
|---|---|
| ***B22D 11/00*** | (2006.01) |
| ***B22D 11/06*** | (2006.01) |
| ***C22C 38/02*** | (2006.01) |
| ***C22C 38/04*** | (2006.01) |
| ***C21D 8/02*** | (2006.01) |

(52) U.S. Cl. ..... 164/476; 164/477; 164/480; 148/320; 148/541

(58) Field of Classification Search ..... 164/476, 164/477, 480; 148/320, 541, 602, 656–658
See application file for complete search history.

(56) References Cited

U.S. PATENT DOCUMENTS

| | | | | |
|---|---|---|---|---|
| 5,567,250 | A * | 10/1996 | Akamatsu et al. | 148/320 |
| 6,328,826 | B1 * | 12/2001 | Iung et al. | 148/541 |
| 6,581,672 | B1 * | 6/2003 | Strezov et al. | 164/452 |
| 6,585,030 | B1 * | 7/2003 | Strezov et al. | 164/455 |
| 6,818,073 | B1 * | 11/2004 | Strezov et al. | 148/320 |

* cited by examiner

*Primary Examiner*—Kuang Y. Lin
(74) *Attorney, Agent, or Firm*—Hahn Loeser & Parks LLP; Arland T. Stein

(57) ABSTRACT

A cast carbon steel strip is prepared by continuously casting in a twin roll caster and cooling to transform the strip from austenite to ferrite at a temperature range between 400° C. and 850° C. at cooling the strip to transform the austenite to ferrite within a temperature range between 400° C. and 850° C. at a cooling rate of greater than 100° C./sec without inhibiting the cooling rate to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa. The cast strip before cooling is passed through a hot rolling mill to reduce the thickness of strip by at least 15% and up to 50%.

27 Claims, 7 Drawing Sheets

PRODUCTION OF THIN STEEL STRIP

CROSS-REFERENCE TO RELATED APPLICATIONS

This application is a continuation-in-part of divisional application Ser. No. 10/689,284, filed Oct. 20, 2003, now abandoned, which was a division of then U.S. patent application Ser. No. 09/967,166, filed 28 Sep. 2001, now U.S. Pat. No. 6,675,869, issued Jan. 13, 2004. This application claims benefit and priority therethrough to U.S. Provisional Application Ser. No. 60/270,861, filed Feb. 26, 2001, and to U.S. Provisional Application Ser. No. 60/236,389, filed Sep. 29, 2000.

BACKGROUND AND SUMMARY OF THE INVENTION

This invention relates to a cast steel strip produced in a strip caster, particularly a twin roll caster.

In a twin roll caster, molten metal is introduced between a pair of contra-rotated horizontal casting rolls, which are cooled so that metal shells solidify on the moving roll surfaces and are brought together at the nip between them to produce a cast strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip. The molten melt forms a casting pool supported on the casting surfaces of the rolls immediately above the nip and extending along the length of the nip. This casting pool is usually confined between side plates or dams held in sliding engagement with end surfaces of the rolls so as to restrain the two ends of the casting pool against outflow, although alternative means such as electromagnetic barriers have also been proposed.

When casting steel strip in a twin roll caster the strip leaves the nip at very high temperatures of the order of 1400° C., or higher, and if exposed to air, exiting cast strip suffers very rapid scaling due to oxidation at such high temperatures.

It has therefore been proposed to shroud the newly cast strip within an enclosure containing a non-oxidizing atmosphere until its temperature has been reduced significantly, typically to a temperature of the order of 1200° C. or less so as to reduce scaling. One such proposal is described in U.S. Pat. No. 5,762,126 according to which the cast strip is passed through a sealed enclosure from which oxygen is extracted by initial oxidation of the strip passing through it. Thereafter, the oxygen content in the sealed enclosure is maintained at less than the surrounding atmosphere by continuing oxidation of the strip passing through it, so as to control the thickness of the scale on the strip emerging from the enclosure. The emerging strip is reduced in thickness in an inline rolling mill and then generally subjected to forced cooling, for example by water sprays, and the cooled strip is then coiled in a conventional coiler typically in 20-ton coils.

Previously, it has been proposed in strip casting to cool the strip through the austenite transformation zone by subjecting the strip to water sprays. Such water sprays are capable of producing maximum cooling rates of the order of 90° C./sec. The degree to which cooling can be used to control cooling rates can be used to control the microstructure of the cast strip as illustrated by U.S. Pat. No. 6,328,826, where cooling rates between 5° C. and 100° C./sec. produce Transformation Induced Plasticity (TRIP) steel with a microstructure of at least 5% austenite and both high strength and high ductility properties suitable for shaping.

Previously, it has been proposed in strip casting to cool the strip to thin steel sheet with excellent stretchability by cooling said thin cast strip from the temperature range of from the casting temperature to 900° C. to a temperature of not higher than 650° C. at an average cooling rate of not less than V (° C./sec) represented by the following formula; and coiling the cooled strip at a temperature of not more than 650° C.:

$$\log V \leqq 0.5-0.8 \log Ceq(^\circ \text{ C./sec})$$

wherein Ceq=C+0.2 Mn. See U.S. Pat. No. 5,567,250. This cooling regime provided a thin cast strip with a microstructure selected from a transgranular acicular ferrite and/or a bainite having a packet size of 30 to 300 μm in a proportion of not less than 95% of the structure. Thus, according to the previous teaching, a low-temperature transformation phase advantageous for the stretch-flange ability can be wholly provided by causing transformation at a certain or higher cooling rate which does not form coarse ferrite. Col. 6, II. 17–28.

According to the present disclosure, a cast steel strip is prepared for example by a process comprising the steps of:

continuously casting molten plain carbon steel into a strip of not more than 5 mm in thickness and including austenite grains;

passing the strip through a roll mill in which the strip is hot rolled to produce a reduction in strip thickness by more than 15%; and cooling the strip to transform the strip austenite to ferrite within the temperature range of between 400° C. to 850° C. at a cooling rate of more than 100° C./sec to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa.

The cast steel strip may be prepared by a process comprising the steps of:

continuously casting molten plain carbon steel into a strip of not more than 5 mm in thickness and including austenite grains;

passing the strip through a roll mill in which the strip is hot rolled to produce a reduction in strip thickness by more than 15%; and continuously cooling the strip to transform the strip austenite to ferrite within the temperature range of between 400° C. to 850° C. at a cooling rate of greater than 100° C./sec without inhibiting the cooling rate to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa.

In the described processes used to produce the cast steel strip, the strip is continuously cast by supporting a casting pool of molten steel on a pair of chilled casting rolls forming a nip between them, and producing cast strip by counter-rotating the casting rolls in opposite directions such that the casted strip moves downwardly from the nip.

In both of the described processes, the cooling step may start at least 10° C. above the $Ar_3$ temperature. The cooling step may start at 800° C. or above. The cooling rate may be in the range from greater than 100° C./sec to 300° C./sec. The strip may be cooled through the transformation temperature range within between 400° C. and 850° C., and not necessarily through that entire temperature range at such a cooling rate. The precise transformation temperature range will vary with the chemistry of the steel composition and processing characteristics.

We have found that it is possible to achieve a remarkable degree of hardenability in typical plain carbon steel chemistry by employing accelerated cooling rates, to promote the formation of low temperature transformation products which enables an increased range of strip products to be produced, particularly with a range of yield strength and hardness, even in the case where inline heat reduction has refined the 'as cast' microstructure.

The term "packet size" refers to the grain orientation within a group of grains of the microstructure. Grains have similar orientation within a packet. Packets are identified in micrographs by the grain orientation change in grains between different packets. A packet size with 10% greater than 300 μm refers to the grain size of the original austenite grains.

The term "low carbon steel" is understood to mean steel of the following composition, in weight percent:

| | |
|---|---|
| C: | 0.02–0.08 |
| Si: | 0.5 or less; |
| Mn: | 1.0 or less; |
| residual/incidental impurities: | 1.0 or less; and |
| Fe: | balance |

The term "residual/incidental impurities" covers levels of elements, such as copper, tin, zinc, nickel, chromium, and molybdenum, that may be present in relatively small amounts, not as a consequence of specific additions of these elements but as a consequence of standard steel making. Elements may be present as a result of using scrap steel to produce plain carbon steel.

The low carbon steel may be silicon/manganese killed and may have the following composition by weight:

| | |
|---|---|
| Carbon | 0.02–0.08% |
| Manganese | 0.30–0.80% |
| Silicon | 0.10–0.40% |
| Sulfur | 0.002–0.05% |
| Aluminum | less than 0.01% |

Silicon/manganese killed steels are particularly suited to twin roll strip casting. A silicon/manganese killed steel will generally have a manganese content of not less than 0.20% (typically about 0.6%) by weight and a silicon content of not less than 0.10% (typically about 0.3%) by weight.

The low carbon steel may be aluminum killed and may have the following composition by weight:

| | |
|---|---|
| Carbon | 0.02–0.08% |
| Manganese | 0.40% max |
| Silicon | 0.05% max |
| Sulfur | 0.002–0.05% |
| Aluminum | 0.05% max |

The aluminum killed steel may be calcium treated.

The cast steel strip may be produced with a yield strength in the range of 450 MPa to in excess of 700 MPa by cooling rates in the range of greater than 100° C./sec to 300° C./sec. However, the aluminum killed steels will be generally 20 to 50 MPa softer than the silicon/manganese killed steels.

The cast steel strip may be passed from the casting pool through an enclosure containing an atmosphere, which inhibits oxidation of the strip surface and consequent scale formation. The atmosphere in said enclosure may be formed of inert or reducing gases or it may be an atmosphere containing oxygen at a level lower than the atmosphere surrounding the enclosure. The atmosphere in the enclosure may be formed by sealing the enclosure to restrict ingress of oxygen containing atmosphere, causing oxidation of the strip within the enclosure during an initial phase of casting thereby to extract oxygen from the sealed enclosure and to cause the enclosure to have an oxygen content less than the atmosphere surrounding the enclosure, and thereafter maintaining the oxygen content in the sealed enclosure at less than that of the surrounding atmosphere by continuous oxidation of the strip passing through the sealed enclosure thereby to control the thickness of the resulting scale on the strip.

The strip may be passed through a rolling mill in which it is hot rolled with a reduction in thickness of up to 50%.

Illustratively, the cast strip passes on to a run-out table with cooling means operable to cool the cast strip transforming the strip from austenite to ferrite in a temperature range of 400° C. to 850° C. at a cooling rate greater than 100° C./sec to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa.

The term "low temperature transformation products" includes Widenmanstatten ferrite, acicular ferrite, bainite and martinsite.

BRIEF SUMMARY OF THE DRAWINGS

In order that the invention may be more fully explained one particular embodiment will be described in detail with reference to the accompanying drawings in which.

DETAILED DESCRIPTION

Figure 1:
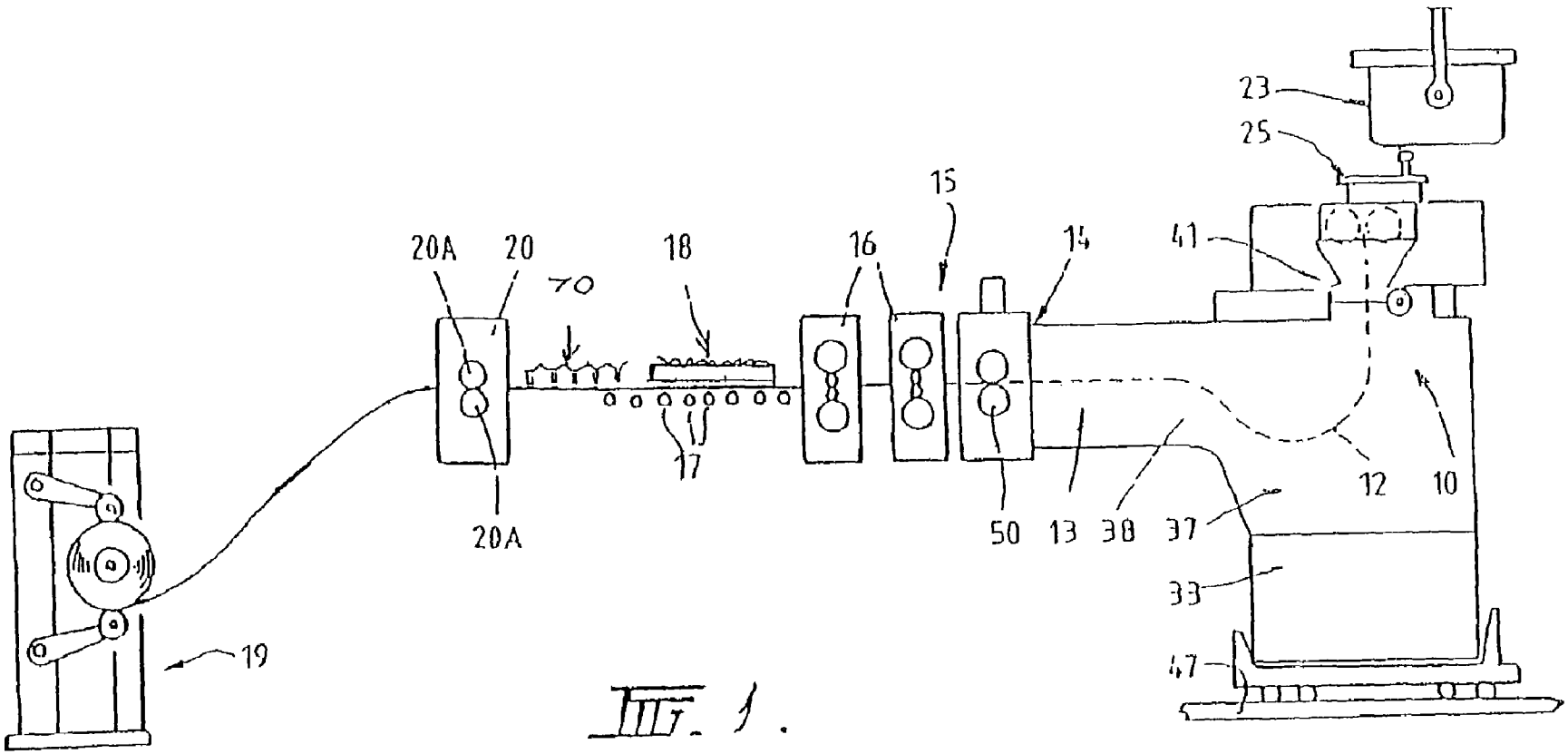
FIG. 1 is a vertical cross-section through a steel strip casting and rolling installation which is operable in accordance with the present invention.
Figure 2:
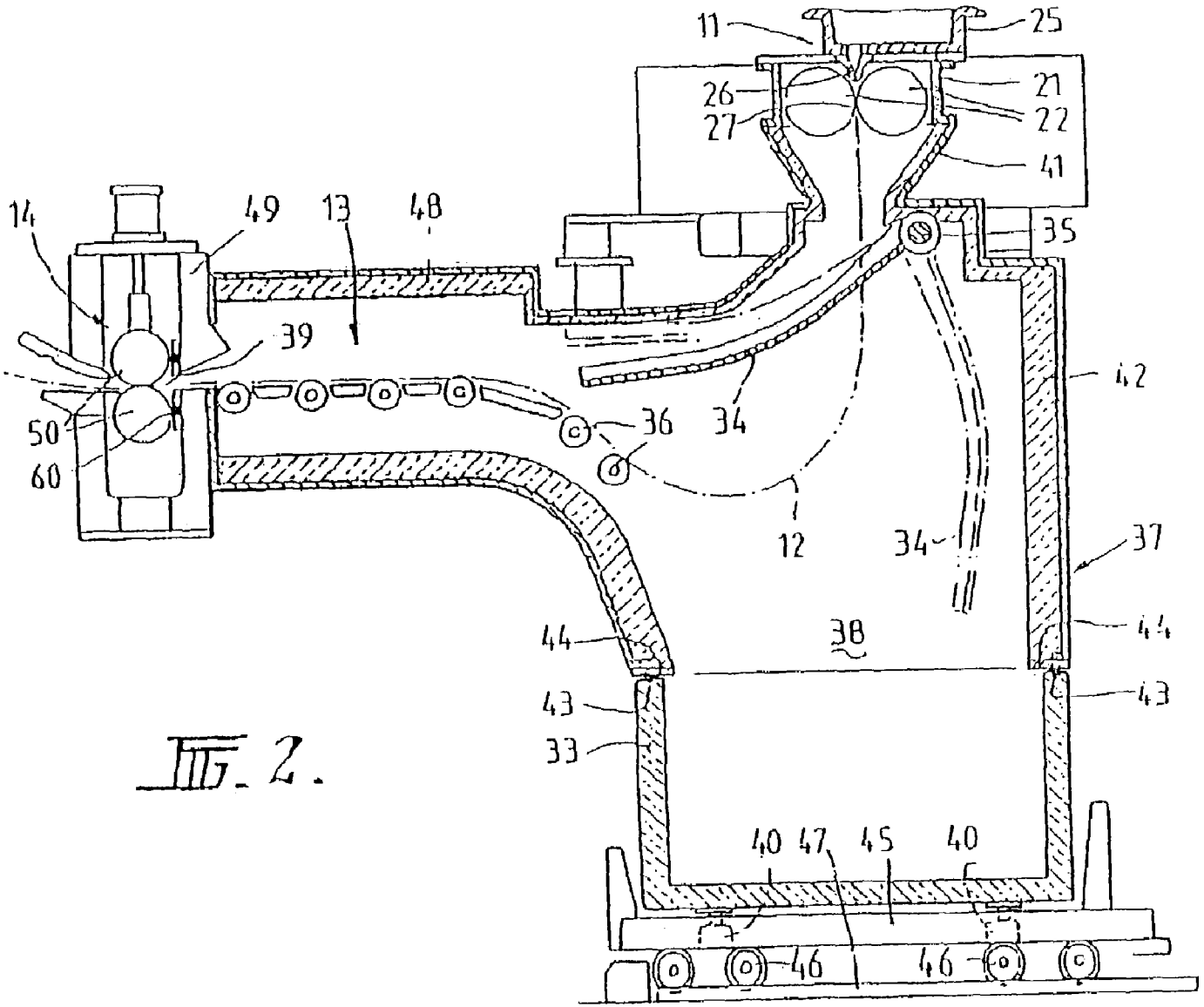
FIG. 2 illustrates components of a twin roll caster incorporated in the installation.
Figure 3:
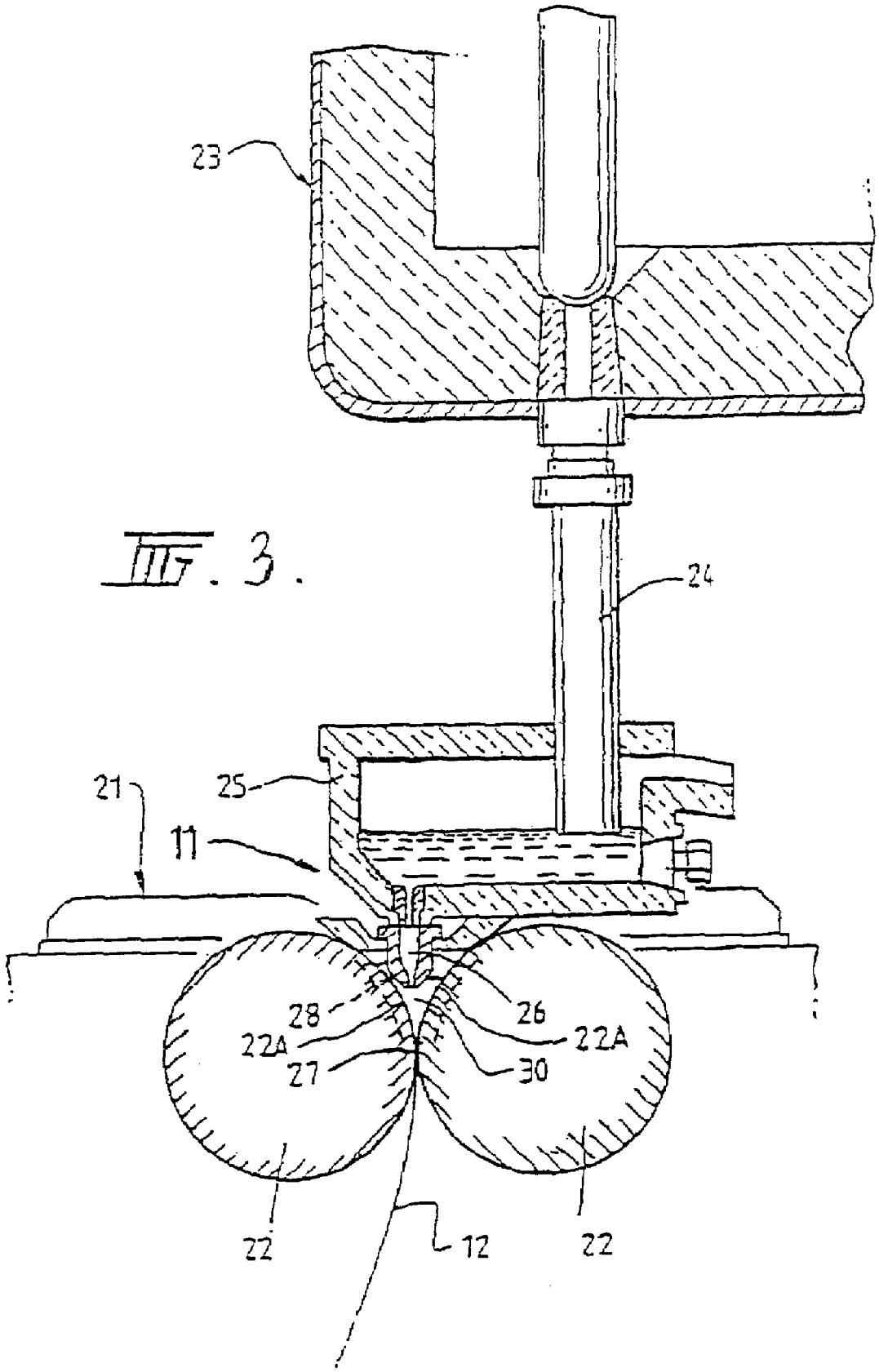
FIG. 3 is a vertical cross-section through part of the twin roll caster.
Figure 4:
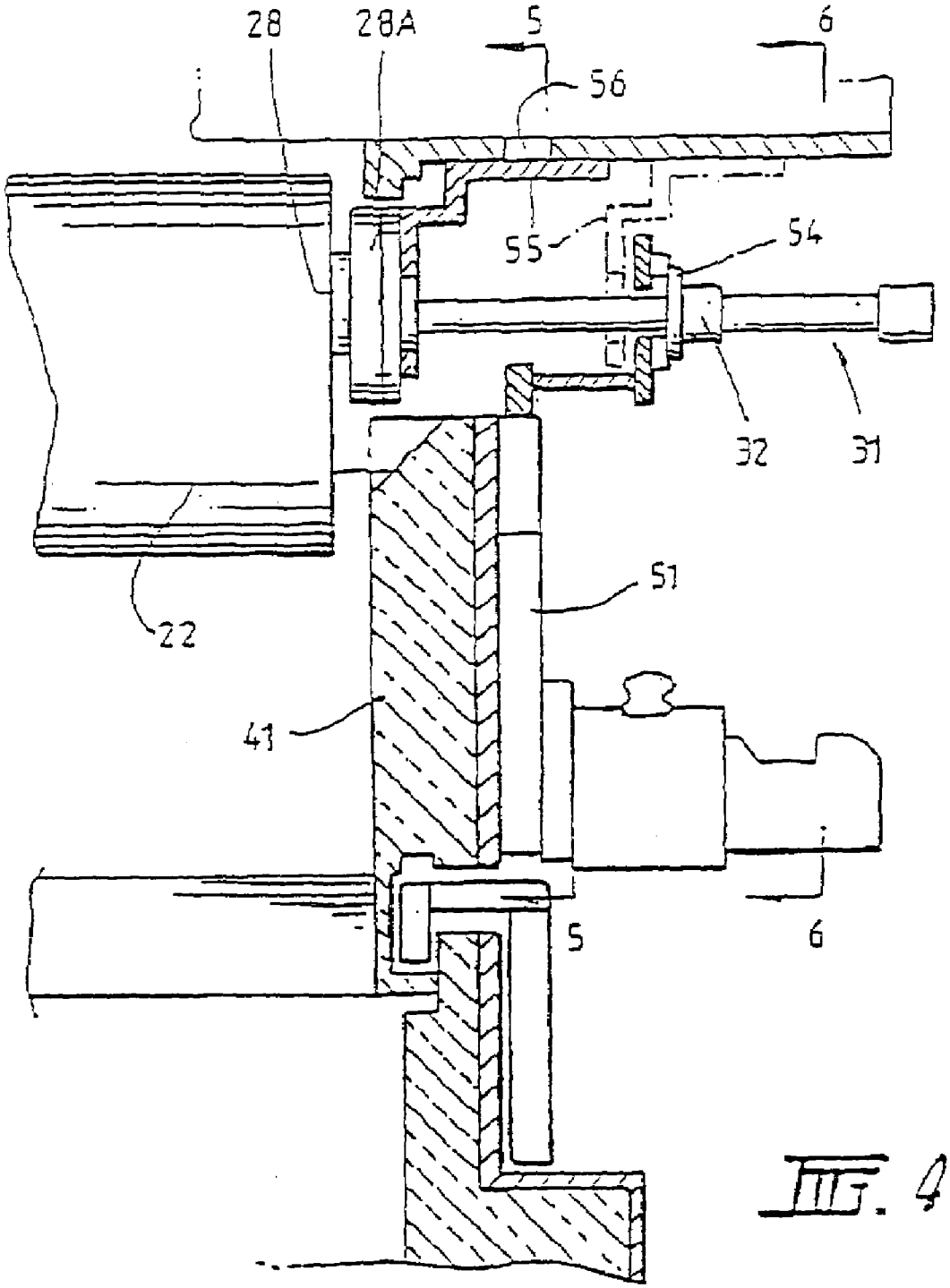
FIG. 4 is a cross-section through end parts of the caster.
Figure 5:
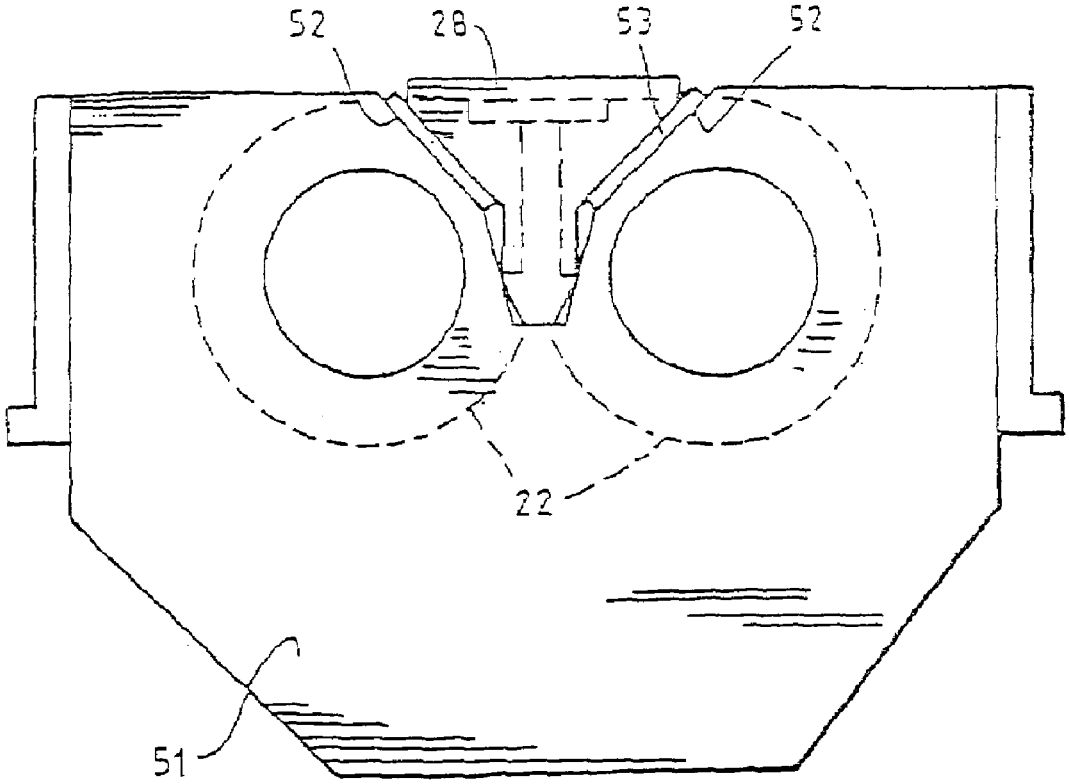
FIG. 5 is a cross-section on the line 5—5 in FIG. 4.
Figure 6:
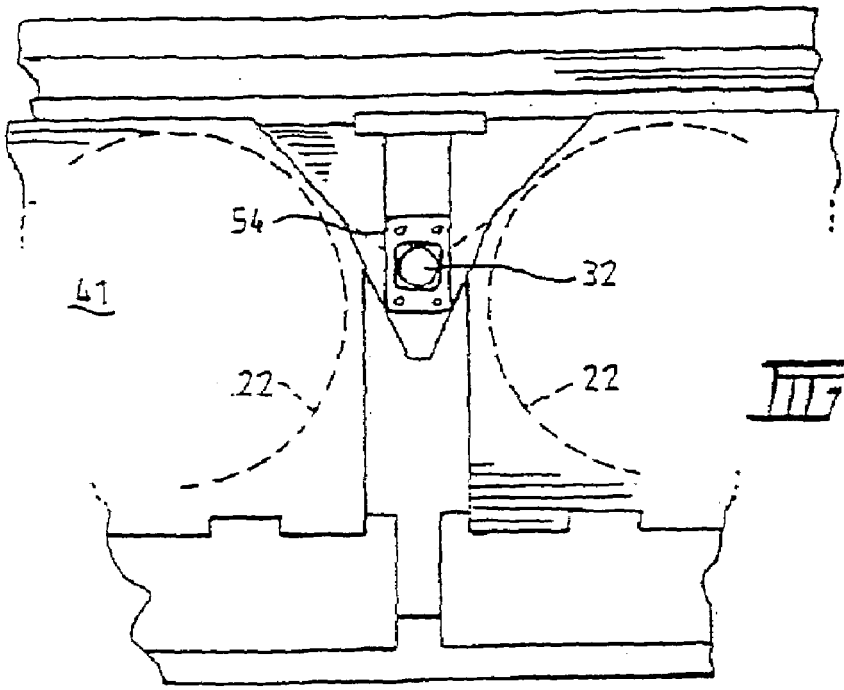
FIG. 6 is a view on the line 6—6 in FIG. 4.

The illustrated casting and rolling installation comprises a twin roll caster denoted generally as 11 which produces a cast steel strip 12 which passes in a transit path 10 across a guide table 13 to a pinch roll stand 14. Immediately after exiting the pinch roll stand 14, the strip passes into a hot rolling mill 15 comprising roll stands 16 in which it is hot rolled to reduce its thickness. The thus rolled strip exits the rolling mill and passes to a run out table 17 on which it can be subjected to accelerated cooling by means of cooling headers 18 in accordance with the present invention or may alternatively be subjected to cooling at lower rates by operation of cooling water sprays 70 also incorporated at the run out table. The strip is then passed between pinch rolls 20A of a pinch roll stand 20 to a coiler 19.

Twin roll caster 11 comprises a main machine frame 21 which supports a pair of parallel casting rolls 22 having casting surfaces 22A. Molten metal is supplied during a casting operation from a ladle 23 through a refractory ladle outlet shroud 24 to a tundish 25 and thence through a metal delivery nozzle 26 into the nip 27 between the casting rolls 22. Hot metal thus delivered to the nip 27 forms a pool 30 above the nip and this pool is confined at the ends of the rolls by a pair of side closure dams or plates 28 which are applied to stepped ends of the rolls by a pair of thrusters 31 comprising hydraulic cylinder units 32 connected to side plate holders 28A. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roller surfaces and are brought together at the nip 27 between them to produce the solidified strip 12, which is delivered downwardly from the nip between the rolls.

At the start of a casting operation a short length of imperfect strip is produced as the casting conditions stabilize. After continuous casting is established, the casting rolls are moved apart slightly and then brought together again to cause this leading end of the strip to break away in the manner described in Australian Patent Application 27036/92 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in a loop beneath the caster before it passes to the guide table 13 where it engages a succession of guide rollers 36.

The twin roll caster may be of the kind which is illustrated and described in some detail in granted Australian Patents 631728 and 637548 and U.S. Pat. Nos. 5,184,668 and 5,277,243 and reference may be made to those patents for appropriate constructional details which form no part of the present invention.

The installation is manufactured and assembled to form a single very large scale enclosure denoted generally as 37 defining a sealed space 38 within which the steel strip 12 is confined throughout a transit path from the nip between the casting rolls to the entry nip 39 of the pinch roll stand 14.

Enclosure 37 is formed by a number of separate wall sections which fit together at various seal connections to form a continuous enclosure wall. These comprise a wall section 41 which is formed at the twin roll caster to enclose the casting rolls and a wall section 42 which extends downwardly beneath wall section 41 to engage the upper edges of scrap box 33 when the scrap box is in its operative position so that the scrap box becomes part of the enclosure. The scrap box and enclosure wall section 42 may be connected by a seal 43 formed by a ceramic fiber rope fitted into a groove in the upper edge of the scrap box and engaging flat sealing gasket 44 fitted to the lower end of wall section 42. Scrap box 33 may be mounted on a carriage 45 fitted with wheels 46 which run on rails 47 whereby the scrap box can be moved after a casting operation to a scrap discharge position. Cylinder units 40 are operable to lift the scrap box from carriage 45 when it is in the operative position so that it is pushed upwardly against the enclosure wall section 42 and compresses the seal 43. After a casting operation the cylinder units 40 are released to lower the scrap box onto carriage 45 to enable it to be moved to scrap discharge position.

Enclosure 37 further comprises a wall section 48 disposed about the guide table 13 and connected to the frame 49 of pinch roll stand 14 which includes a pair of pinch rolls 14A against which the enclosure is sealed by sliding seals 60. Accordingly, the strip exits the enclosure 38 by passing between the pair of pinch rolls 14A and it passes immediately into the hot rolling mill 15. The spacing between pinch rolls 50 and the entry to the rolling mill should be as small as possible and generally of the order of 5 meters or less so as to control the formation of scale prior to entry into the rolling mill.

Most of the enclosure wall sections may be lined with firebrick and the scrap box 33 may be lined either with firebrick or with a castable refractory lining.

The enclosure wall section 41 which surrounds the casting rolls is formed with side plates 51 provided with notches 52 shaped to snugly receive the side dam plate holders 28A when the side dam plates 28 are pressed against the ends of the rolls by the cylinder units 32. The interfaces between the side plate holders 28A and the enclosure side wall sections 51 are sealed by sliding seals 53 to maintain sealing of the enclosure. Seals 53 may be formed of ceramic fiber rope.

The cylinder units 32 extend outwardly through the enclosure wall section 41 and at these locations the enclosure is sealed by sealing plates 54 fitted to the cylinder units so as to engage with the enclosure wall section 41 when the cylinder units are actuated to press the side plates against the ends of the rolls. Thrusters 31 also move refractory slides 55 which are moved by the actuation of the cylinder units 32 to close slots 56 in the top of the enclosure through which the side plates are initially inserted into the enclosure and into the holders 28A for application to the rolls. The top of the enclosure is closed by the tundish, the side plate holders 28A and the slides 55 when the cylinder units are actuated to apply the side dam plates against the rolls. In this way the complete enclosure 37 is sealed prior to a casting operation to establish the sealed space 38 whereby to limit the supply of oxygen to the strip 12 as it passes from the casting rolls to the pinch roll stand 14. Initially the strip will take up all of the oxygen from the enclosure space 38 to form heavy scale on the strip. However, the sealing of space 38 controls the ingress of oxygen containing atmosphere below the amount of oxygen that could be taken up by the strip. Thus, after an initial start up period the oxygen content in the enclosure space 38 will remain depleted so limiting the availability of oxygen for oxidation of the strip. In this way, the formation of scale is controlled without the need to continuously feed a reducing or non-oxidizing gas into the enclosure space 38. In order to avoid the heavy scaling during the start-up period, the enclosure space can be purged immediately prior to the commencement of casting so as to reduce the initial oxygen level within the enclosure and so reduce the time for the oxygen level to be stabilized as a result of the interaction of oxygen from the sealed enclosure due to oxidation of the strip passing through it. The enclosure may conveniently be purged with nitrogen gas. It has been found that reduction of the initial oxygen content to levels of between 5% to 10% will limit the scaling of the strip at the exit from the enclosure to about 10 microns to 17 microns even during the initial start-up phase.

In a typical caster installation the temperature of the strip passing from the caster will be of the order of 1400° C. and the temperature of the strip presented to the mill may be about 900° C. to 1100° C. The strip may have a width in the range 0.9 m to 2.0 m and a thickness in the range 0.7 mm to 2.0 mm. The strip speed may be of the order of 1.0 m/sec. It has been found that with strip produced under these conditions it is quite possible to control the leakage of air into the enclosure space 38 to such a degree as to limit the growth of scale on the strip to a thickness of less than 5 microns at the exit from the enclosure space 38, which equates to an average oxygen level of 2% within that enclosure space. The volume of the enclosure space 38 is not particularly critical since all of the oxygen will rapidly be taken up by the strip during the initial start up phase of a casting operation and the subsequent formation of scale is determined solely by the rate of leakage of atmosphere into the enclosure space though the seals. It is preferred to control this leakage rate so that the thickness of the scale at the mill entry is in the range 1 micron to 5 microns. Experimental work has shown that the strip needs some scale on its surface to prevent welding and sticking during hot rolling. Specifically, this work suggests that a minimum thickness of the order of 0.5 to 1 micron is necessary to ensure satisfactory rolling. An upper limit of about 8 microns and preferably 5 microns is desirable to avoid "rolled-in scale" defects in the strip surface after rolling and to ensure that scale thickness on the final product is no greater than on conventionally hot rolled strip.

After leaving the hot rolling mill the strip passes to run out table 17 on which it is subjected to accelerated cooling by the cooling headers 18 before being coiled on coiler 19.

Cooling headers 18 are of the kind generally called "laminar cooling" headers which are used in conventional hot strip mills. In conventional hot strip mills, the strip speeds are much higher than in a thin strip caster, typically of the order of ten times as fast. Laminar cooling is an effective way of presenting large volumetric flows of cooling water to the strip to produce much higher cooling rates than possible with water spray systems. It had previously been thought that laminar cooling was inappropriate for strip casters because the much higher cooling intensity would not allow conventional coiling temperatures. Accordingly, it has been previously proposed to use water sprays for cooling the strip. However, in a twin roll strip caster using both water spray systems and laminar cooling headers, we have determined that the final microstructure and the physical properties of a plain carbon steel strip can be dramatically affected by varying the cooling rate as the strip is cooled through the austenite transformation temperature range and that the capability of accelerated cooling at cooling rates in the range greater than 100° C./sec to 300° C./sec, or even higher, enables the production of cast strip with increased yield strength which have beneficial properties for some commercial applications by having less than about 1% austenite with a microstructure and having a packet size of at least 10% greater than 300 μm, either (i) a mixture of polygonal ferrite and low temperature transformation products or (ii) predominantly low temperature transformation products, and a yield strength greater than 450 MPa. The "low temperature transformation products" includes Widenmanstatten ferrite, acicular ferrite, bainite and martinsite.

The cooling step starts at least 10° C. above the $Ar_3$ temperature. The cooling step may start at 800° C. or above, for example at 820° C.

Figure 8:
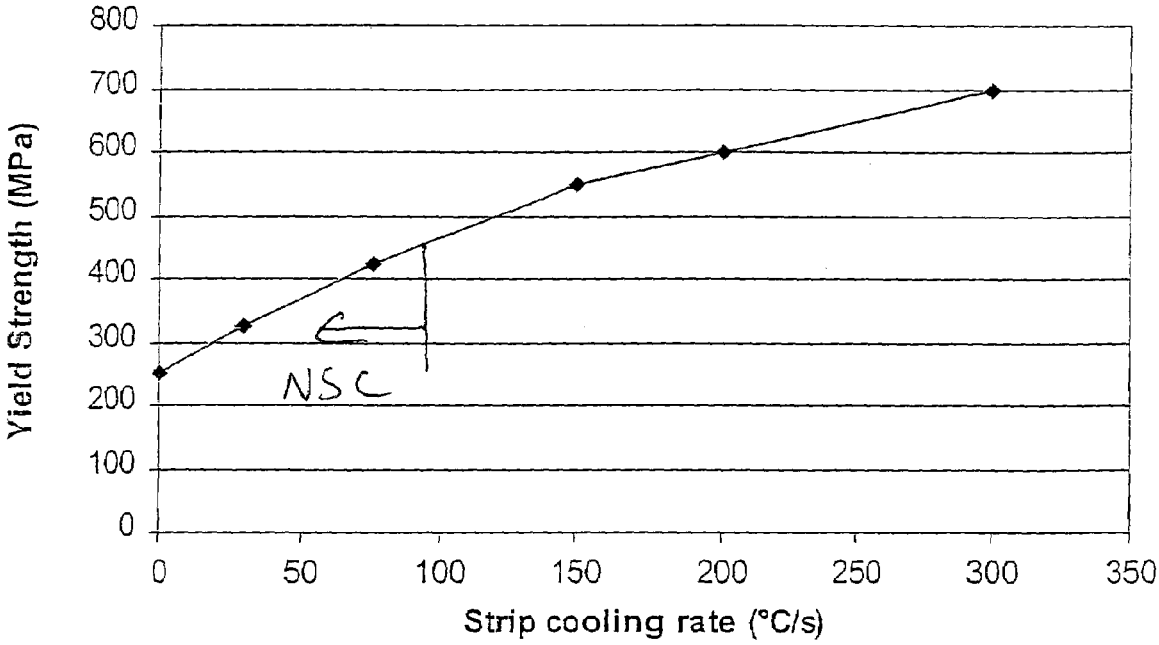
FIG. 8 shows graphically strip properties obtained under varying cooling conditions.

As the cooling rate is increased above 120° C./sec the final microstructure changes from predominantly polygonal ferrite (with a grain size of 10–40 microns) to a mixture of polygonal ferrite and low temperature transformation products with consequent increases in yield strength. This is illustrated in FIG. 8 which shows progressively increasing yield strength of the strip with increasing cooling rates.

Accelerated cooling can be achieved in a typical strip caster by means of laminar cooling headers operating with specific water flux values of the order of 40 to 60 $m^3/hr.m^2$. Typical conditions for accelerated cooling are set out in Table 1.

TABLE 1

ACCELERATED COOLING SYSTEM REQUIREMENTS
For Strip width = 1.345 m, Casting speed = 80 m/min, Strip thickness = 1.6 mm

| | Laminar Cooling System Requirements | | | |
|---|---|---|---|---|
| Cooling rate C. °/sec | Total water $m^3/hr$ | Cooling bank Length, m | Specific Water flux $m^3/hr \cdot m^2$ | heat transfer coeff. $W/m^2K$ |
| 150 | 320 | 2.66 | 45 | 908 |
| 200 | 320 | 2.0 | 60 | 1208 |
| 300 | 320 | 1.33 | 90 | 1816 |

Hot rolling temperatures of around 1050° C. produce microstructures with polygonal ferrite content of more than 80% with grains in the size range 10 to 40 microns.

Figure 7:
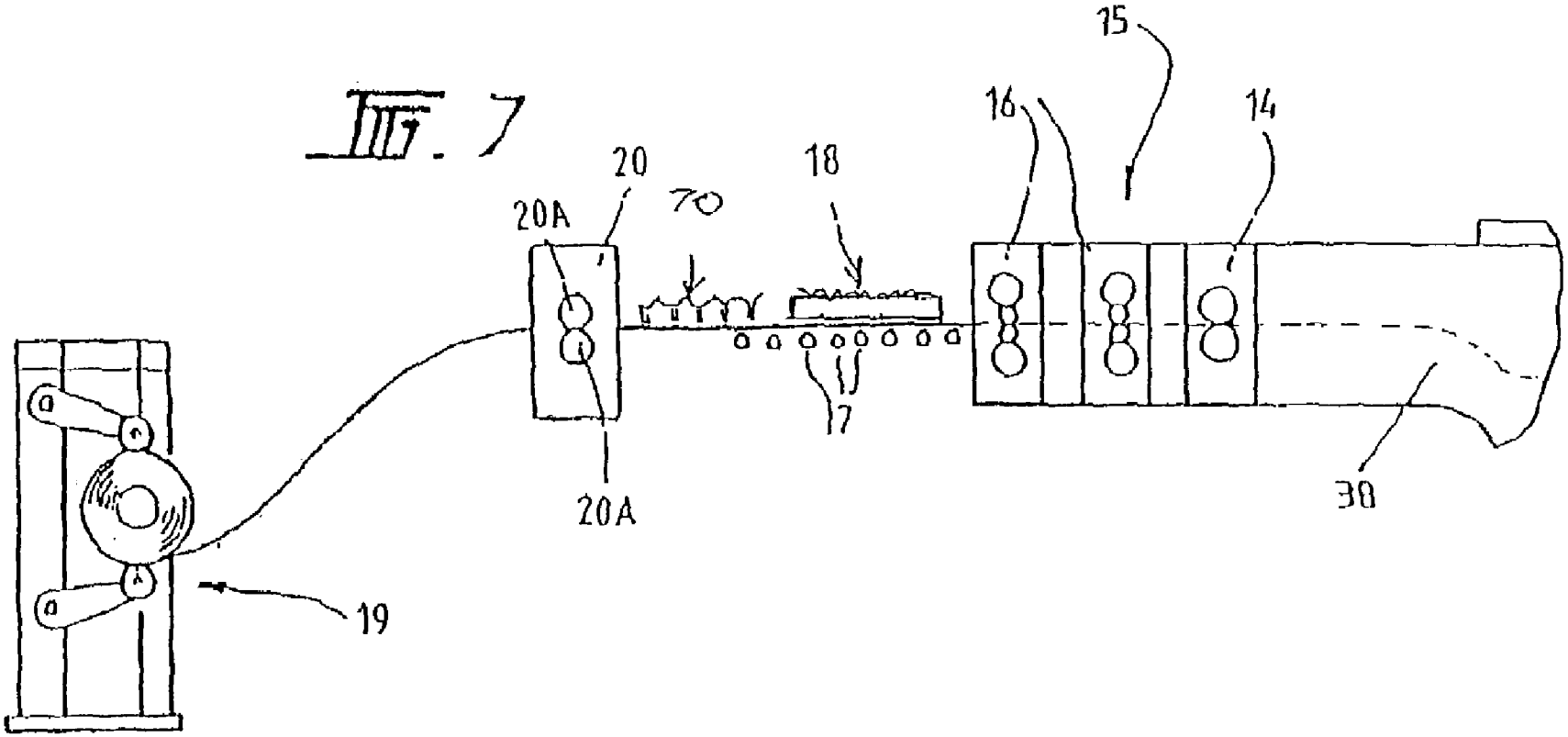
FIG. 7 is a diagrammatic view of part of a modified installation also operable in accordance with the invention.

In cases where the strip is to be hot rolled, it would be possible to incorporate the inline rolling mill within the protective enclosure 37 so that the strip is rolled before it leaves the enclosure space 38. A modified arrangement is illustrated in FIG. 7. In this case the strip exits the enclosure through the last of the mill stands 16, the rolls of which serve also to seal the enclosure so that separate sealing pinch rolls are not required.

The illustrated apparatus incorporates both an accelerated cooling header 18 and a conventional water spray cooling system 70 to allow a full range of cooling regimes to be selected according to the strip properties required. The accelerated cooling header system is installed on the run out table in advance of a conventional spray system.

In a typical installation as illustrated in FIG. 1, the inline rolling mill may be located 10.5 m from the nip between the casting rolls, the accelerated cooling header may be spread about 16 m from the nip and the water sprays may be spread about 18 m from the nip.

Although laminar cooling headers are a convenient means of achieving accelerated cooling in accordance with the invention it would also be possible to obtain accelerated cooling by other techniques, such as by the application of cooling water curtains to the upper and lower surfaces of the strip across the full width of the strip.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the spirit of the invention. Additional features of the invention will become apparent to those skilled in the art upon consideration of the detailed description, which exemplifies the best mode of carrying out the invention as presently perceived.

What is claimed is:

1. A cast steel strip prepared by a process comprising the steps of:

supporting a casting pool of molten low carbon steel on a pair of chilled casting rolls forming a nip between them and continuously casting solidified strip of no more than 5 mm in thickness and including austenite grains by rotating the rolls in mutually opposite directions such that the solidified strip moves downwardly from the nip;

passing the strip through a rolling mill in which it is hot rolled to produce a reduction in the strip thickness of at least 15%, and cooling the strip to transform the austenite to ferrite within a temperature range between 850° C. and 400° C. and at a cooling rate of more than 100° C./sec to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa.

2. The cast steel strip of claim 1 wherein the cooling step starts at least 10° C. above the $Ar_3$ temperature.

3. The cast steel strip of claim 2 wherein the cooling step starts at 800° C. or above.

4. The cast steel strip of claim 1 wherein the low carbon steel is a silicon/manganese killed steel, and the strip is hot rolled in the temperature range of 900° C. to 1100° C. and then is cooled at a cooling rate in the range of greater than 100° C./sec to 300° C./sec to produce a cast strip having a yield strength of at least 450 MPa.

5. The cast steel strip of claim 1 wherein the low carbon steel is a silicon/manganese killed steel, and the strip is cooled at a cooling rate in the range of greater than 100° C./sec to 300° C./sec to produce a cast strip with a yield strength of at least 450 MPa.

6. The cast steel strip of claim 5 wherein the yield strength is between 450 MPa and 700 MPa.

7. The cast steel strip of claim 4 wherein the yield strength is between 450 MPa and 700 MPa.

8. The cast steel strip of claim 1 wherein the low carbon steel is a silicon/manganese killed steel having the following composition by weight:

| | |
|---|---|
| Carbon | 0.02–0.08% |
| Manganese | 0.30–0.80% |
| Silicon | 0.10–0.40% |
| Sulfur | 0.002–0.05% |
| Aluminum | less than 0.01%. |

9. The cast steel strip of claim 1 wherein the low carbon steel is aluminum killed steel.

10. The cast steel strip of claim 1 wherein the aluminum killed steel has the following composition by weight:

| | |
|---|---|
| Carbon | 0.02–0.08% |
| Manganese | 0.40% max |
| Silicon | 0.05% max |
| Sulfur | 0.002–0.05% |
| Aluminum | 0.05% max. |

11. The cast steel strip of claim 10 wherein the cooling rate is in the range greater than 100° C./sec to 300° C./sec.

12. The cast steel strip of claim 10 wherein the final cast steel strip has a yield strength in the range of 450 MPa to 700 MPa.

13. The cast steel strip of claim 12 wherein the cast steel has the following composition by weight:

| | |
|---|---|
| Carbon | 0.02–0.08% |
| Manganese | 0.30–0.80% |
| Silicon | 0.10–0.40% |
| Sulfur | 0.002–0.05% |
| Aluminum | less than 0.01%. |

14. A cast steel strip prepared by a process comprising the steps of:

supporting a casting pool of molten low carbon steel on a pair of chilled casting rolls forming a nip between them and continuously casting solidified strip of no more than 5 mm in thickness and including austenite grains by rotating the rolls in mutually opposite directions such that the solidified strip moves downwardly from the nip;

passing the strip through a rolling mill in which the strip is hot rolled to produce a reduction in the strip thickness of at least 15%; and continuously cooling the strip to transform the austenite to ferrite within a temperature range between 400° C. and 850° C. at a cooling rate of greater than 100° C./sec without inhibiting the cooling rate to form cast strip that is less than about 1% austenite and has a packet size of at least 10% greater than 300 μm, is either (i) a mixture of polygonal ferrite and low temperature transformation products or (ii) predominantly low temperature transformation products, and has a yield strength of at least 450 MPa.

15. The cast steel strip of claim 14 wherein the cooling rate starts at least 10° C. above the $Ar_3$ temperature.

16. The cast steel strip of claim 14 wherein cooling step starts at 800° C. or above.

17. The cast steel strip of claim 16 wherein said cooling rate is in the range greater than 100° C./sec to 300° C./sec.

18. The cast steel strip of claim 14 wherein the low carbon steel is a silicon/manganese killed steel having the following composition by weight:

| | |
|---|---|
| Carbon | 0.02–0.08% |
| Manganese | 0.30–0.80% |
| Silicon | 0.10–0.40% |
| Sulfur | 0.002–0.05% |
| Aluminum | less than 0.01%. |

19. The cast steel strip of claim 14 wherein the low carbon steel is aluminum killed steel.

20. The cast steel strip of claim 19 wherein the aluminum killed steel has the following composition by weight:

| | |
|---|---|
| Carbon | 0.02–0.08% |
| Manganese | 0.40% max |
| Silicon | 0.05% max |
| Sulfur | 0.002–0.05% |
| Aluminum | 0.05% max. |

21. The cast steel strip of claim 14 wherein said cooling rate is in the range greater than 100° C./sec to 300° C./sec and the strip has a yield strength of at least 450 MPa.

22. The cast steel strip of claim 21 wherein the strip has a yield strength in the range of 450 MPa to 700 MPa.

23. The cast steel strip of claim 14 wherein the low carbon steel is a silicon/manganese killed steel, and the strip is cooled at a cooling rate in the range greater than 100° C./sec to 300° C./sec to produce a strip having a yield strength of at least 450 MPa.

24. The cast steel strip of claim 23 wherein the final strip has a yield strength in the range of 450 MPa to 700 MPa.

25. The cast steel strip of claim 14 wherein the low carbon steel is a silicon/manganese killed steel, and the strip is hot rolled in the temperature range of 900° C. to 1100° C. and then is cooled at a cooling rate in the range of greater than 100° C./sec to 300° C./sec to produce a final strip having a yield strength of at least 450 MPa.

26. The cast steel strip of claim 25 wherein the final strip has a yield strength in the range of 450 MPa to 700 MPa.

27. The cast steel strip of claim 26 wherein the steel has the following composition by weight:

| | |
|---|---|
| Carbon | 0.02–0.08% |
| Manganese | 0.30–0.80% |
| Silicon | 0.10–0.40% |
| Sulfur | 0.002–0.05% |
| Aluminum | less than 0.01%. |

* * * * *